US006098670A

United States Patent [19]

Baumann

[11] Patent Number: 6,098,670

[45] Date of Patent: Aug. 8, 2000

[54] APPARATUS FOR TENSIONING WARP THREADS FOR A WEAVING MACHINE AND A WEAVING MACHINE WITH AN APPARATUS OF THIS KIND

[75] Inventor: Heinz Baumann, Winterthur, Switzerland

[73] Assignee: Sulzer Rüti Ag, Rüti, Switzerland

[21] Appl. No.: 09/251,846

[22] Filed: Feb. 17, 1999

[30] Foreign Application Priority Data

Feb. 18, 1998 [EP] European Pat. Off. ..... 98810131

[51] Int. Cl.[7] ..... D03D 49/12

[52] U.S. Cl. ..... 139/110; 139/115

[58] Field of Search ..... 139/110, 115; 242/154

[56] References Cited

U.S. PATENT DOCUMENTS

| | | | |
|---|---|---|---|
| 3,930,523 | 1/1976 | Garcia | 139/110 |
| 4,480,665 | 11/1984 | Imamura et al. | 139/110 |
| 4,690,176 | 9/1987 | Thalmann et al. | 139/110 |
| 5,305,802 | 4/1994 | Fehrenbach | 139/110 |
| 5,743,307 | 4/1998 | Derudder et al. | 139/110 |
| 5,890,519 | 4/1999 | De Jager et al. | 139/110 |

FOREIGN PATENT DOCUMENTS

| | | |
|---|---|---|
| 0271021A2 | 6/1988 | European Pat. Off. . |
| 0350447A1 | 1/1990 | European Pat. Off. . |
| 0396501A1 | 11/1990 | European Pat. Off. . |
| 0409306A1 | 1/1991 | European Pat. Off. . |
| 0812940A1 | 12/1997 | European Pat. Off. . |
| 4310840C1 | 1/1994 | Germany . |
| 4432452A1 | 3/1995 | Germany . |
| 4427126A1 | 2/1996 | Germany . |

*Primary Examiner*—Andy Falik
*Attorney, Agent, or Firm*—Townsend and Townsend and Crew LLP

[57] ABSTRACT

An apparatus for applying substantially uniform tension to warp threads along a warp thread path in a weaving machine. The apparatus has a carrier element (5), a tensioner element (7) for the warp threads which is multiply supported thereon, said tensioner element being pivotal about the axis of the carrier element, and a drive apparatus (8) which is connected drivewise to the carrier element. The drive apparatus (8) consists of a motor (9) and a kinematic chain which is connected to the carrier element (5) in such a manner that the introduction of the forces into the carrier element takes place substantially symmetrically with respect to its longitudinal extent.

10 Claims, 4 Drawing Sheets

APPARATUS FOR TENSIONING WARP THREADS FOR A WEAVING MACHINE AND A WEAVING MACHINE WITH AN APPARATUS OF THIS KIND

The invention relates to an apparatus for tensioning warp threads for a weaving machine an apparatus for applying substantially uniform tension to warp threads along a warp thread path in a weaving machine and to a weaving machine with an apparatus of this kind.

BACKGROUND OF THE INVENTION

The apparatuses for the tensioning of warp threads have a tensioner beam which is under spring action and/or is in contact with electric motors in order to maintain the tension of the warp threads. In this the introduction of the force takes place at both ends of the tensioner beam.

Normally, quite big load acts on the tensioner element (7) in particular at large web widths as in a loom and when a heavy fabric is woven. It is disclosed, for example in EP 0 271 021 or EP 0 396 501, to introduce the force into the tensioner element (7) at one side of the element (7). This causes torsion of the tensioner element (7) with respect to the longitudinal extent of the element (7). Therefore, tension of the warp threads is different in longitudinal direction, which causes an irregular fabric. In particular technical fabrics, for example used for filters or air bags, must be very regular and therefore cannot be produced by the apparatus disclosed in EP 0 271 021 or EP 0 396 501. Alternately, the tensioner element (7) can be made massive.

It proves disadvantageous that the tensioner beam must be made massive in order to avoid a torsion, in particular at large web widths. A tensioner beam with a large mass already represents a disadvantage per se.

SUMMARY OF THE INVENTION

The object of the invention is to improve an apparatus for the tensioning of warp threads.

This object is satisfied in accordance with the invention in that a drive apparatus (8,21) which is connected to the carrier element is intended to pivot the carrier element (5) and/or to move the carrier element (5) in a translatory manner.

The advantages which can be achieved by the invention are to be seen substantially in that a tensioner element having low mass is provided, with the position of the tensioner element for the achieving of a specific warp thread tension being controllable via a drive motor and in that a uniform warp thread tension can be achieved over the width of the web.

A weaving machine with an apparatus for the tensioning of warp threads a control unit is integrated into the drive apparatus to enable freely selectable movements during a weaving cycle.

The invention will be explained in the following with reference to the accompanying drawings.

DESCRIPTION OF THE PREFERRED EMBODIMENTS

Figure 1:
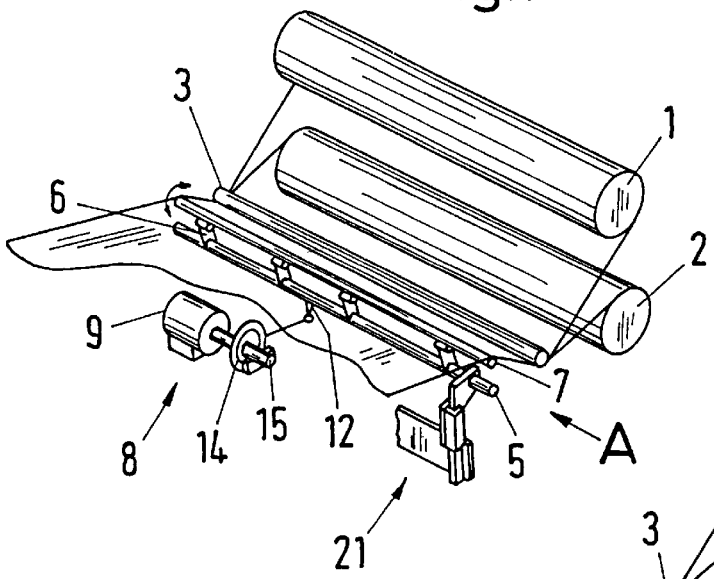
FIG. 1 a first embodiment of an apparatus in accordance with the invention in a spatial illustration.

Reference is made to FIGS. 1 to 6, with the same reference numeral being used for the same features. For the sake of a better understanding of the description of the present invention, two warp beams 1, 2 and one deflection beam 3 are shown in the figures in each case in order to show the path of the warp threads. The apparatuses have in each case a carrier element 5, a number of support elements 6 which can be mounted on the carrier element, a tensioner element 7 which is rotatably arranged on the support elements and a drive apparatus 8 with a motor 9 and a kinematic chain which is releasably connected to and/or is connected displaceably along the carrier element. Furthermore, a control unit 10 is provided which permits the carrying out of temporally freely selectable movements of the tensioner element during a weaving cycle.

As shown in FIG. 1, in the first embodiment the kinematic chain comprises a lever 12 which is mounted on the carrier element and a crank drive 14 with a settable eccentricity and which is pivotally connected to the lever. The crank drive 14 is fastened at the drive axle 15 of the motor 9 and connected to the lever 12.

In a second embodiment the kinematic chain comprises two levers 12 which are connected to the carrier element, a first intermediate member 16 which is arranged parallel to the carrier element and connected to the two levers 12 via two connection members 14, as well as the crank drive 14.

In a third embodiment the kinematic chain comprises four levers 12 which are mounted on the carrier element and connected via four connection links 17 to a second intermediate member 18, with the intermediate member 18 being arranged parallel to the carrier element, and are furthermore connected drive-wise to the crank drive 14 at the drive side via two further levers 12 and two further connection links 17. The second intermediate member is thus arranged between the carrier element and the first intermediate member and parallel to the latter. The connection links 17 connect in each case the carrier element 5 to the second intermediate member 18 on the one hand and the second intermediate member 18 to the first intermediate member 16 on the other hand.

Figure 2:
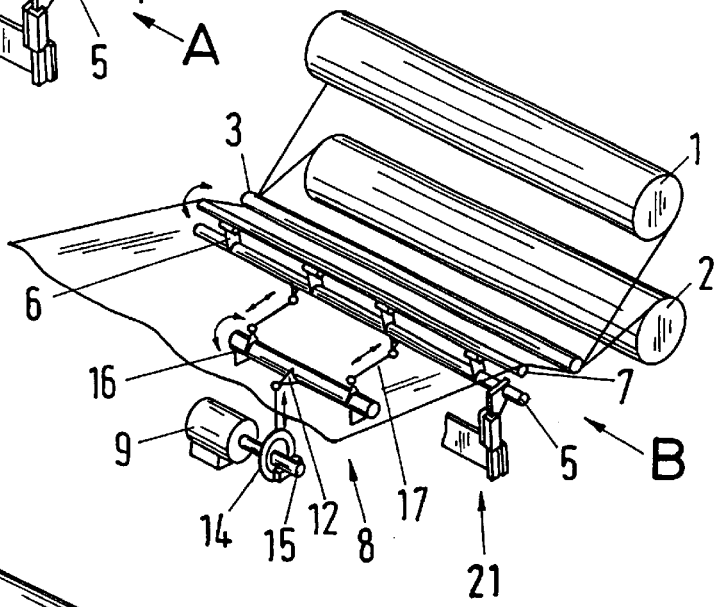
FIG. 2 a second embodiment of an apparatus in accordance with the invention in a spatial illustration.
Figure 3:
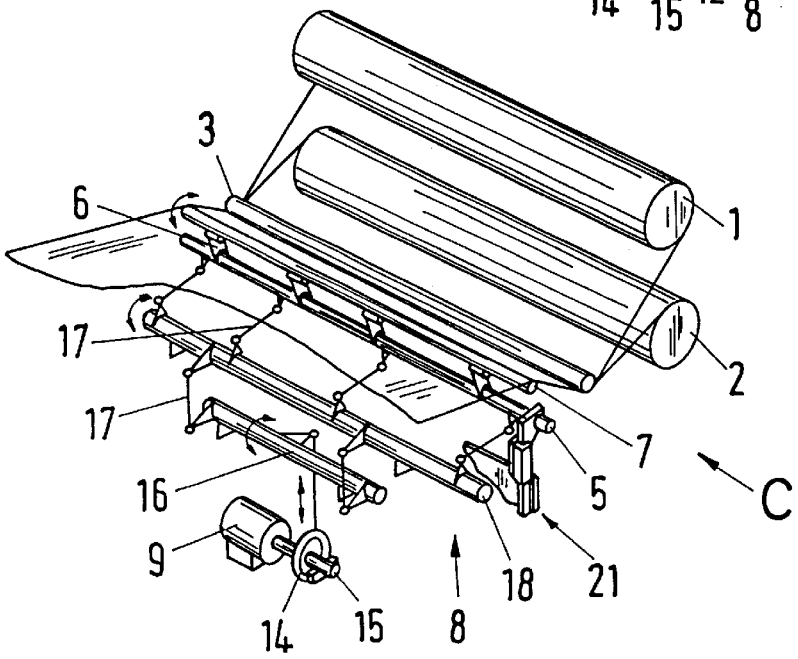
FIG. 3 a third embodiment of an apparatus in accordance with the invention in a spatial illustration.
Figure 4:
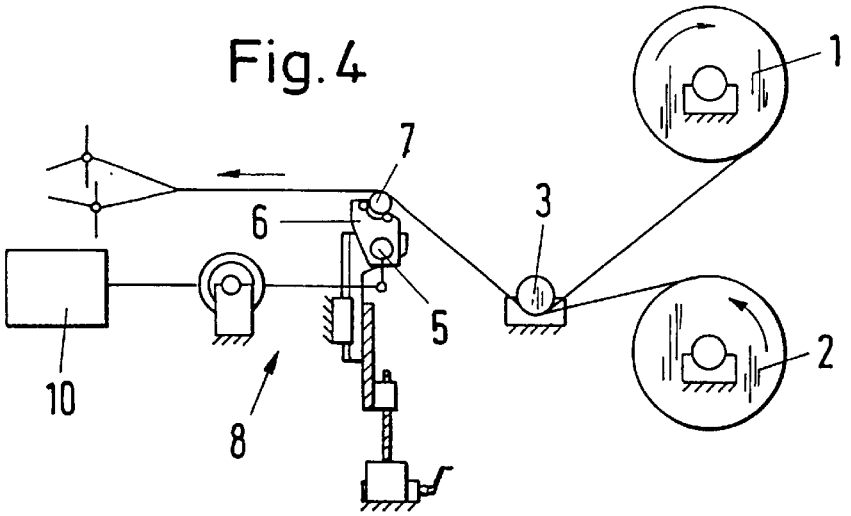
FIG. 4 a view in the direction of the arrow A in FIG. 1.

As can be seen in FIGS. 1 to 3, the kinematic chain is constructed symmetrically so that the force transmission from the motor 9 up to the carrier element 5 takes place uniformly. The levers 12 and the connection links 17 are constructed identically so that the force transmission takes place in the ratio 1:1. It is pointed out that the design of the kinematic chain is in each case determined by the equipment of the warp threads or their width so that other embodiments of the kinematic chain can be used.

Figure 7:
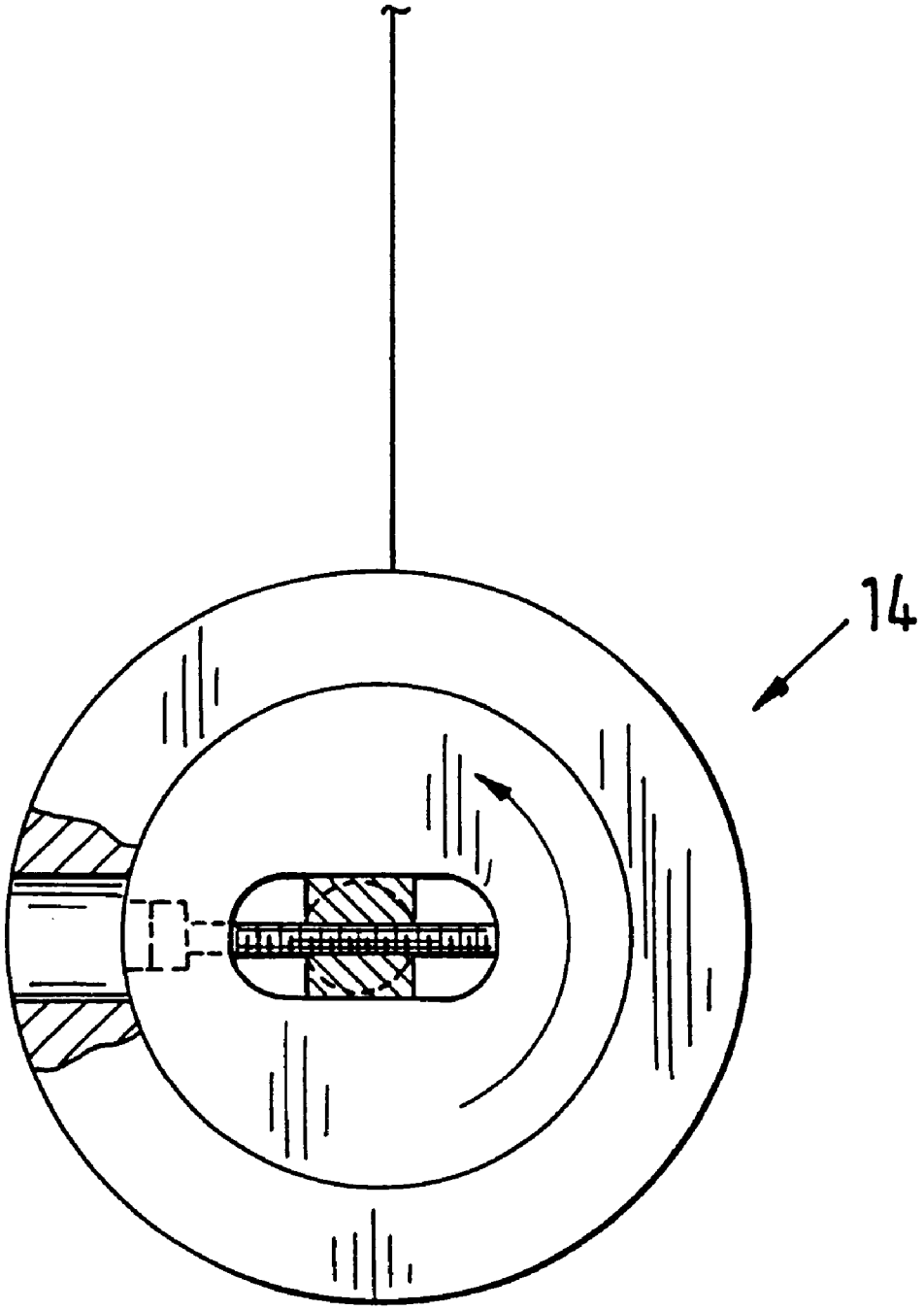
FIG. 7 a view of the crank drive.
Figure 8:
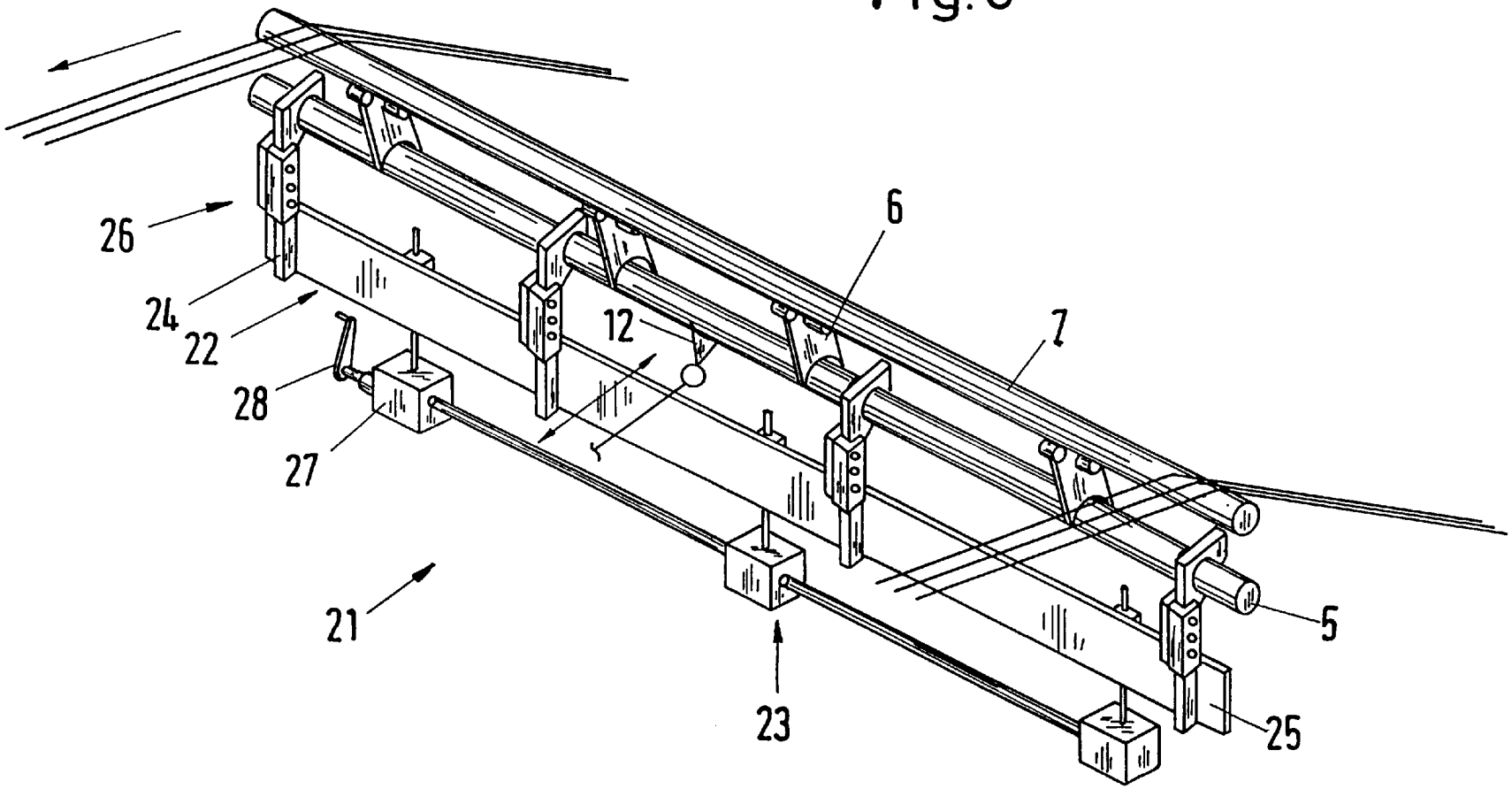
FIG. 8 an embodiment of an apparatus for adjusting the support element.

Reference is made to FIG. 7. As already mentioned, the eccentricity of the crank drive can be adjusted. A device is provided at the crank drive for this in order to displace the rotational axis of the crank drive with respect to the rotational axis of the motor.

In these apparatuses the phase relationship of the pivotal region, i.e. the starting time point and/or the running time as well as the torque of the motor can be changed within a weaving cycle in an advantageous manner through the setting of the eccentricity of the crank drive of the pivotal region and through corresponding control of the motor. It is thereby achieved for example that a high warp tension is achieved during the reed beat-up and that the warp tension can be reduced afterwards in order to avoid breakings of the warp threads.

Figure 5:
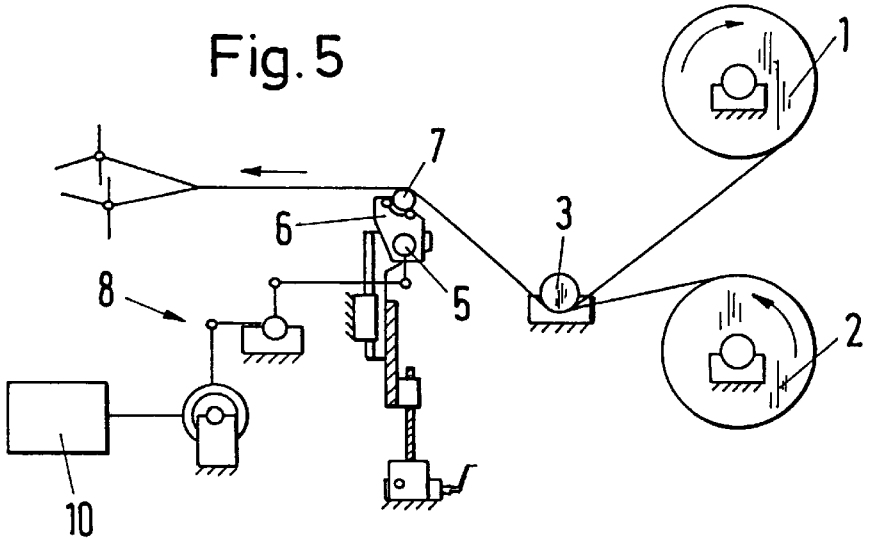
FIG. 5 a view in the direction of the arrow B in FIG. 2.
Figure 6:
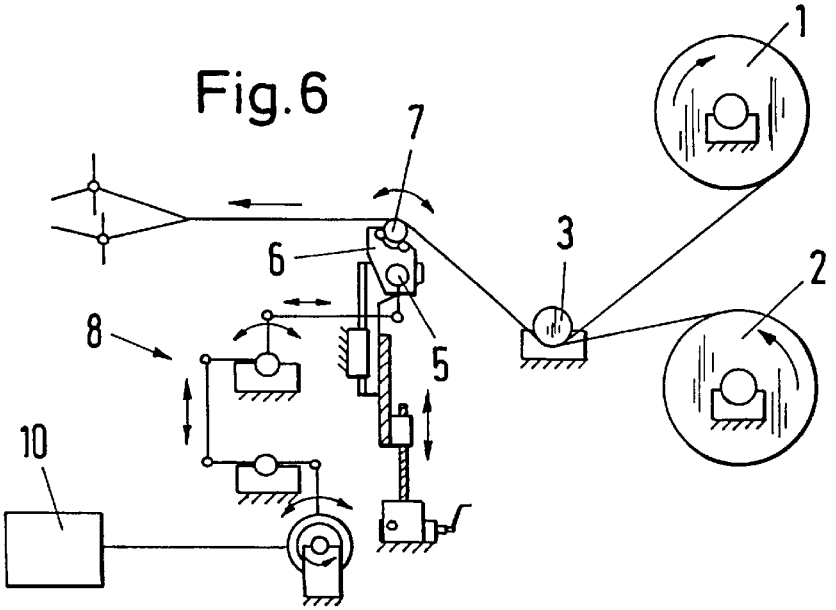
FIG. 6 a view in the direction of the arrow C in FIG. 3.

The above described apparatuses are mounted in each case on a device 21 which comprises an arrangement 22 for holding the carrier element 5 and which comprises a transmission arrangement 23 in order to adjust the position of the tensioner element 7 in the vertical direction. As shown in FIG. 5, the arrangement 22 has a number of supports 24 in which the carrier element 5 is pivotally journalled. The supports 24 are mutually connected by means of a transverse member 25 and guided in guide members 26 which are mounted on the frame of a non-illustrated weaving machine. The transmission arrangement consists of three worm drives 27 which are connected in each case to the transverse member 25 and can be driven in common by means of a crank 28. Instead of the crank, a motor can be provided, and instead of the worm drives, a setting means driven with a fluid.

With this device the setting of the tensioner element and thus the inlet angle of the warp threads is changed with respect to the shed forming members and the non-illustrated reed in an advantageous manner.

The apparatus has a carrier element 5, a tensioner element 7 for the warp threads which is multiply supported thereon, said tensioner element being pivotal about the axis of the carrier element, and a drive apparatus 8 which is connected drivewise to the carrier element. The drive apparatus 8 consists of a motor 9 and a kinematic chain which is connected to the carrier element 5 in such a manner that the introduction of the forces into the carrier element takes place substantially symmetrically with respect to its longitudinal extent.

What is claimed is:

1. Apparatus for applying substantially uniform tension to warp threads along a warp thread path in a weaving machine comprising:

a carrier element mounted for rotation along a longitudinal axis substantially normal to the path of the warp threads;

a tensioner element for contacting the warp threads across the warp thread path, the tensioner element centrally symmetrically pivotally mounted about longitudinal axis of the carrier element with respect to the warp thread path;

a drive apparatus for applying a force to the carrier element; and, a connection for receiving the force from the drive apparatus and transmitting torque centrally and symmetrically to the carrier element, the connection applying torque to the centrally and symmetrically to the carrier element whereby the tensioner element as centrally symmetrically pivotally mounted about longitudinal axis of the carrier element maintains a uniform tension on the warp threads along the warp thread path.

2. Apparatus for applying substantially uniform tension to warp threads along a warp thread path in a weaving machine according to claim 1 and comprising in further combination:

a kinematic chain applies torque centrally and symmetrically to the carrier element.

3. Apparatus for applying substantially uniform tension to warp threads along a warp thread path in a weaving machine according to claim 1 and comprising in further combination:

the drive apparatus for applying a force to the carrier element constitutes a motor providing a cyclic force.

4. Apparatus for applying substantially uniform tension to warp threads along a warp thread path in a weaving machine according to claim 2 and comprising in further combination:

the kinematic chain has a crank drive from the motor.

5. Apparatus for applying substantially uniform tension to warp threads along a warp thread path in a weaving machine according to claim 2 and comprising in further combination:

a first intermediate member is parallel to the carrier element;

the kinematic chain connects at a first link to the first intermediate member; and, parallel links connect the first intermediate member to carrier element.

6. Apparatus for applying substantially uniform tension to warp threads along a warp thread path in a weaving machine according to claim 5 and comprising in further combination:

a second intermediate member is parallel to the carrier element between the first intermediate member and the carrier element;

parallel links connect the first intermediate member to the second intermediate member; and, parallel links connect the second intermediate member to the carrier element.

7. Apparatus for applying substantially uniform tension to warp threads along a warp thread path in a weaving machine according to claim 4 and comprising in further combination:

the kinematic chain having a crank drive from the motor has means for setting the eccentricity of the crank.

8. Apparatus for applying substantially uniform tension to warp threads along a warp thread path in a weaving machine according to claim 1 and comprising in further combination:

the drive apparatus for applying a force to the carrier element has a cycle in synchronization with the group consisting of the starting time point of the weaving cycle; the running time of the weaving cycle; and, the torque within a weaving cycle.

9. Apparatus for applying substantially uniform tension to warp threads along a warp thread path in a weaving machine according to claim 1 and comprising in further combination:

the carrier element is journalled in a holder; and, the holder is mounted for adjustable movement to move the carrier element in a vertical direction.

10. Apparatus for applying substantially uniform tension to warp threads along a warp thread path in a weaving machine according to claim 1 and comprising in further combination:

a control unit is connected to the drive apparatus to enable freely selectable movements during a weaving cycle.

* * * * *